US011305317B2

(12) United States Patent
Belosevic et al.

(10) Patent No.: US 11,305,317 B2
(45) Date of Patent: Apr. 19, 2022

(54) ROCK PROCESSING PLANT

(71) Applicant: Kleemann GmbH, Göppingen (DE)

(72) Inventors: Vjekoslav Belosevic, Göppingen (DE); Otto Blessing, Bartholomä (DE); Lars Rudolph, Stuttgart (DE)

(73) Assignee: Kleemann GmbH

( * ) Notice: Subject to any disclaimer, the term of this patent is extended or adjusted under 35 U.S.C. 154(b) by 0 days.

(21) Appl. No.: 17/023,641

(22) Filed: Sep. 17, 2020

(65) Prior Publication Data

US 2021/0101181 A1 Apr. 8, 2021

(30) Foreign Application Priority Data

Oct. 4, 2019 (DE) ..... 10 2019 126 778.1

(51) Int. Cl.
*B07B 13/16* (2006.01)
*B07B 1/00* (2006.01)

(52) U.S. Cl.
CPC ..... *B07B 13/16* (2013.01); *B07B 1/005* (2013.01); *B07B 2201/04* (2013.01)

(58) Field of Classification Search
CPC ..... B07B 1/005; B07B 1/28; B07B 13/16; B07B 2201/04
(Continued)

(56) References Cited

U.S. PATENT DOCUMENTS 5,183,160 A * 2/1993 McClain ..... B07B 1/005 209/234
5,335,784 A 8/1994 Tyler
(Continued)

FOREIGN PATENT DOCUMENTS

DE 1758896 B1 3/1972
DE 202005003660 U1 6/2005
(Continued)

OTHER PUBLICATIONS

European Patent Office search report for corresponding European patent application No. 20194273.7, dated Feb. 22, 2021, 7 pages (not prior art).

*Primary Examiner* — Joseph C Rodriguez
(74) *Attorney, Agent, or Firm* — Lucian Wayne Beavers; Patterson Intellectual Property Law, PC

(57) ABSTRACT

The invention relates to a rock processing plant (10) having a machine frame (13), which supports a screening unit (20), wherein the screening unit (20) has at least two screen decks (21, 22), which are arranged offset from each other in the vertical direction (H) of the rock processing plant (10), wherein the screen decks (21, 22) each have a discharge area (A1, A2), wherein a transport device (15) is connected to the screening unit (22) in the conveying direction, wherein the transport device (15) has a feed area (15.1) and a discharge area (15.2), wherein a transport means, in particular an endless circulating conveyor belt (15.3), extends in a transport direction (D) at least partially between the feed area (15.1) and the discharge area (15.2), wherein the transport device (15) is attached to the machine frame (13) by means of a mechanical actuator (31), wherein the mechanical actuator (31) can be used to move the feed area (15.1) of the transport device (15) between two control positions, in which the feed area (15.1) is optionally assigned to one of the discharge areas (A1, A2) of the two screen decks (21, 22) or both discharge areas (A1, A2), and wherein the mechanical actuator (31) can be used to move the feed area (15.1) of the transport device (15) between the two control positions in the vertical direction and in the transport direction (D) of the transport device (15). Such a rock processing plant has a simple and space-saving design, which permits a conversion to the different operating positions with little effort.

12 Claims, 5 Drawing Sheets

(58) Field of Classification Search
USPC ..... 209/240, 241, 255, 257
See application file for complete search history.

(56) References Cited

U.S. PATENT DOCUMENTS

| | | | | |
|---|---|---|---|---|
| 5,749,471 | A | 5/1998 | Andersson | |
| 6,698,594 | B2 * | 3/2004 | Cohen | B07B 1/005 209/421 |
| 6,705,449 | B2 * | 3/2004 | Wagstaffe | B02C 21/02 198/313 |
| 6,877,610 | B2 * | 4/2005 | Boast | B02C 21/02 209/257 |
| 7,461,746 | B1 * | 12/2008 | Egge | B02C 21/02 209/268 |
| 8,505,738 | B2 * | 8/2013 | O'Keeffe | B07B 1/46 209/421 |
| 8,783,443 | B2 * | 7/2014 | Erkkila | B65G 41/007 198/506 |
| 9,085,015 | B2 * | 7/2015 | Schirm | B07B 1/46 |
| 9,776,214 | B2 * | 10/2017 | Vallelly | B65G 47/20 |
| 11,033,933 | B2 * | 6/2021 | Rafferty | B07B 1/005 |
| 11,078,024 | B2 | 8/2021 | Geywitz et al. | |
| 2020/0061632 | A1 * | 2/2020 | Venturi | B02C 4/423 |
| 2021/0069750 | A1 * | 3/2021 | Mcdevitt | B07B 1/005 |

FOREIGN PATENT DOCUMENTS

| | | | |
|---|---|---|---|
| EP | 3041610 | A1 | 7/2016 |
| EP | 3482836 | A1 | 5/2019 |
| EP | 3771493 | A1 | 2/2021 |
| GB | 1238905 | A | 7/1971 |
| GB | 2309923 | A | 8/1997 |
| GB | 2459287 | A | 10/2009 |
| WO | 2006051165 | A1 | 5/2006 |
| WO | 2015033010 | A1 | 3/2015 |

* cited by examiner

ROCK PROCESSING PLANT

CROSS-REFERENCES TO RELATED APPLICATIONS

This application claims benefit of German Patent Application No. 10 2019 126 778.1, filed Oct. 4, 2019, and which is hereby incorporated by reference.

BACKGROUND OF THE INVENTION

1. Field of the Invention

The invention relates to a rock processing plant. Such rock processing plants can be designed as mobile screening stations, for instance. These screening stations may be stand-alone plants or they may be directly assigned to a rock crushing plant (for instance, jaw crushers, rotary impact crushers, etc.).

2. Description of the Prior Art

Such a rock processing plant is known from EP 3 482 836 A1. Such rock processing plants have a machine frame, which supports a screening unit, wherein the screening unit has at least two screen decks, which are arranged offset from one another in the vertical direction, in particular in the direction of gravity of the rock processing plant.

The screen decks can be used to separate material fractions. Accordingly, a material fraction is discharged from the screen deck, the grain size of which is such that it does not fall through the screen deck. The material fraction having smaller grain size passes through the screen deck and falls onto another screen deck below or, for instance, onto a transport device. The screen decks each have a discharge area. In this discharge area, the material fraction, which does not fall through the screen deck, can be discharged from the working area of the screening unit.

An endlessly circulating transfer belt is connected to the screening unit of EP 3 482 836 A1 in the direction of conveyance of the screening unit. This transfer belt takes on the screening material downstream of the screening unit in the discharge area and transports it away transverse from the conveying direction of the screening unit.

The transfer belt then transfers the screened-out material to a return belt. This return belt routes the screening material back to a crusher unit. The transfer belt can be adjusted in the vertical direction and transverse to its longitudinal extension in order to assign it either to the upper screen deck or to both screen decks. If it is assigned to the upper screen deck, it discharges the rock material supplied from this screen deck from the discharge area of this screen deck. If it is assigned to the lower screen deck, it discharges the rock material supplied from both screen decks from the discharge area of both screen decks.

In the first control position, in which the transfer belt is assigned to the upper screen deck, a lateral discharge belt can be installed on the machine frame, which then discharges the rock material from the lower screen deck.

Using an additional transfer belt requires a high number of parts and a lot of assembly work. In addition, this transfer belt has a considerable influence on the installed size of the rock processing plant.

In a second embodiment variant, described in EP 3 482 836 A1, an actuator is used, which can be used to adjust the entire screening unit including the two screen decks between two control positions in the vertical direction. Accordingly, the two screen decks are displaced in conjunction in the vertical direction. This also results in a high mechanical effort. In addition, the feed unit upstream of the screening unit must also be converted for the rock material to be fed to the screening unit in the proper manner.

SUMMARY OF THE INVENTION

The invention addresses the problem of providing a rock processing plant of the type mentioned above, which can be converted with little effort in such a way that either one isolated or several rock fractions together can be discharged from the discharge area of the screening unit.

This problem is solved by the feed area of the transport device being movable between the two control positions in the vertical direction and in the transport direction of the transport device by means of the mechanical actuator.

Because the transport device is adjusted in the vertical direction and additionally in the transport direction of the transport device, the transfer belt, which is required in the state of the art, can be omitted. In particular, the rock material from the discharge area(s) of the screening unit can be fed directly onto the transport device and removed from the working area of the rock processing plant. The rock material discharged via the transport device can then be piled up on a rock pile next to the machine, in particular directly in the discharge area of the transport device.

The mechanical actuator may, for instance, consist of a hydraulic cylinder or a motor-driven actuator unit or have such a unit.

According to a preferred variant of invention, provision may be made that the transport device is attached to the machine frame by means of a swivel bearing in the first and/or in the second control position such that it can be adjusted about a swivel axis in such a way that the inclination of the transport device can be changed in the first and/or in the second control position.

The swivel bearing can be used to adjust the inclination of the transport device and thus the height of the discharge area. Preferably, such an inclination adjustment can be performed in both control positions. To do so, the swivel bearing itself is moved between the two control positions in the event of an offset, resulting in the swivel axis of this swivel bearing assuming different spatial positions in their respective control positions. Preferably, it may however also be provided to have different swivel bearings at different bearing locations in the two control positions.

Preferably, it may be provided that the inclination of the transport device with respect to the horizontal can be continuously adjusted in an angular range between 0° and 35° or in accordance with modular dimensions. Particularly preferably, this angular range is maintained for both control positions of the transport device. The angular range may also be described as between about 0° and at least about 35°.

A particularly preferred variant of the invention is such that the mechanical actuator is used to effect the inclination of the transport device with respect to the horizontal on the one hand and the movement of the feed area of the transport device between the two control positions in the vertical direction and in the transport direction of the transport device on the other hand. In this way, the mechanical actuator has a dual function, which results in a further reduction of the number of parts and amount of assembly work.

According to a conceivable invention alternative, provision may be made that a support with a locking device is effective between the transport device and the machine frame, one support part of which support is coupled to the machine frame and the other support part is coupled to the transport device, and that the two support parts, which are adjustable relative to each other, can be locked relative to each other in different control positions (which may also be referred to as locking positions), which are assigned to different inclinations of the transport device relative to the horizontal, in a form-fitting manner and using a form-fit element. The form-fit connection can be used to reliably secure the alignment of the transport device. This can be particularly advantageous if, for instance, a hydraulic cylinder is used as the mechanical actuator. It can then be relieved by the form-fit connection in the assigned control position. The support can be used to support the transport device in relation to the machine frame or to suspend it therefrom.

To simplify the work, provision may advantageously be made to couple the mechanical actuator to the two support parts such that the two support parts are moved relative to each other when subjected to force upon movement of the actuator. The mechanical actuator can be used to move the two support parts relative to each other. Then the form-fit connection can be used to secure the control positions reached.

A compact rock processing plant can be designed if provision is made that the mechanical actuator or the support can optionally rest on a support part of the machine frame or of the transport device in a form-fitting manner in at least two mounting positions by means of a mounting element, wherein the mounting positions are spaced apart in the vertical direction. Preferably, the mounting positions are then assigned to the different control positions of the transport device. If the transport device is adjusted downwards in the vertical direction, the lower mounting position can also be selected for the mechanical actuator or the support, for instance. By adjusting the mounting positions, the direction of action of the mechanical actuator or the support can be arranged at a sufficiently steep angle of attack to the transport device such that the adjusting force provided by the mechanical actuator is sufficient to cause the transport device to be actuated or that the support provides a sufficient supporting force.

If, in addition, provision is made that the adjustment motion of the mechanical actuator or the support between the two mounting positions is guided, at least partially, by means of a guide piece, which can be moved in a guide of the support part, then the conversion between the two mounting positions can be easily accomplished.

A particularly preferred variant of the invention is such that a swivel mechanism is effective between the machine frame and the transport device, which swivel mechanism is used to guide the displacement of the feed area between the two control positions. The swivel mechanism can be used to move the transport device in a controlled manner between the two control positions, wherein the kinetic energy required for the adjustment is provided simultaneously with that for the mechanical actuator.

A particularly simple design is achieved by the swivel mechanism having a holder and a swingarm, in that the holder and the swingarm are each coupled directly or indirectly to the machine frame by means of a joint and each coupled directly or indirectly to the transport device by means of a further joint to form a four-bar linkage system. The holder and the swingarm therefore form the rods of the four-bar linkage system. The four-bar linkage system can provide a stable and reliable guidance of the transport device. In particular, such a four-bar linkage system can be used to easily achieve the desired height adjustment and the simultaneous adjustment in the transport direction of the transport device.

In a conceivable variant of the invention, provision may in particular be made that the four-bar linkage system is designed as a parallelogram-shaped four-bar linkage system. However, this is not absolutely necessary. In particular, it is not necessary for the holder and the swingarm to be parallel to each other.

According to the invention, provision may also be made that the swivel mechanism comprises the holder, that a holding element is arranged on the transport device or on the machine frame, that the holder comprises a catch element, that in a first position of the transport device the catch element is not in engagement with the holding element and in a second position of the transport device the catch element is in engagement with the holding element.

According to the invention, provision may also be made that a holding element is arranged on the transport device or on the machine frame, that the holder of the swivel mechanism comprises a catch element and that in a first position of the transport device the catch element is not in engagement with the holding element and in a second position of the transport device the catch element is in engagement with the holding element. In this way, the holder of the swivel mechanism can be disengaged from the holding element in a control position of the transport device. Accordingly, the inclination of the transport device can then be adjusted according to the user's wishes without being influenced by the holding element. If the holder catches the holding element, the swivel mechanism is coupled to the transport device and the transport device can then be moved to the second control position.

A conceivable alternative of the invention can be such that in the first control position the transport device is held on a first swivel bearing in a swiveling manner about a first swivel axis and in a second control position of the transport device the stationary swivel bearing for the transport device is formed by the holding element and the holder.

If then additionally provision is made that in the second control position, in which the stationary swivel bearing for the transport device is formed by the holding element and the holder, that the articulation link, which can be used to swivel the transport device relative to the swingarm, can be moved in a positioning guide transverse to the axis of articulation, then an inclination adjustment of the transport device can also be effected in a simple manner in the second control position. For such an inclination adjustment, the articulation link is displaced in the positioning guide.

The invention is explained in greater detail below based on an exemplary embodiment shown in the drawings. In the Figures:

DETAILED DESCRIPTION

Figure 1:
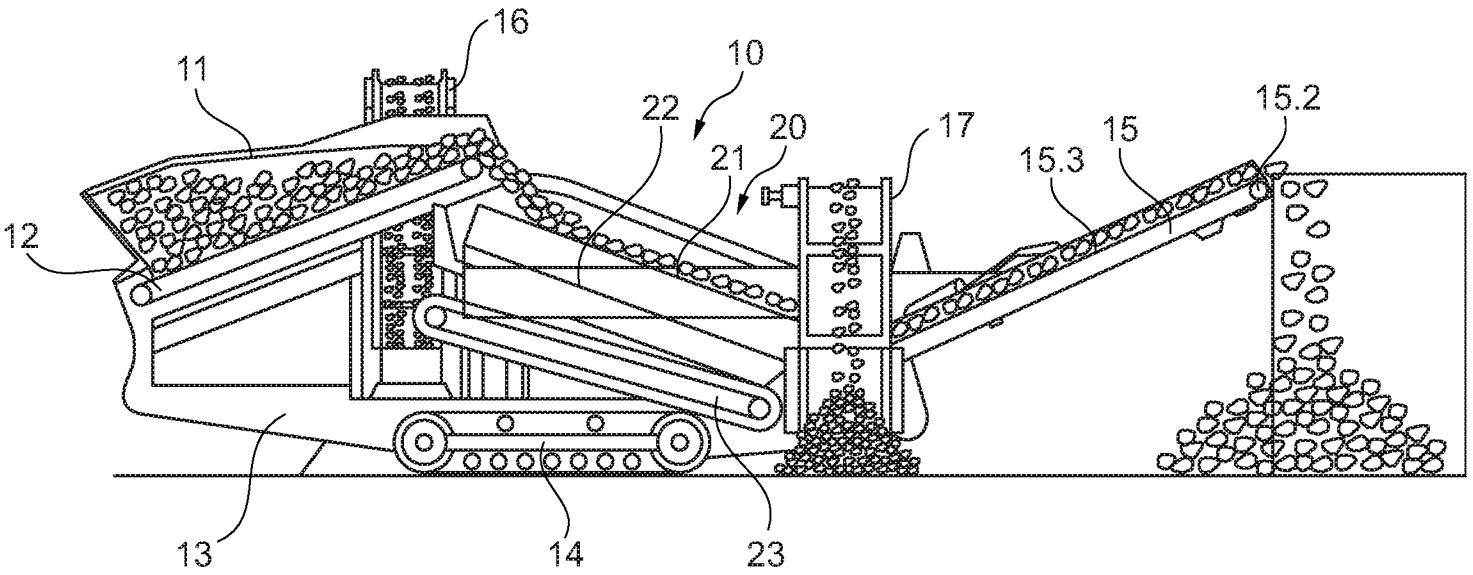
FIG. 1 shows a side view of a schematic representation of a rock processing plant.

FIG. 1 shows a rock processing plant 10, which is used to explain the invention by way of example. This rock processing plant 10 shown is a screening machine. However, the invention is not limited to the application at a screening machine. On the contrary, the invention may also be applied to another rock processing plant, such as a rock crusher, in particular a jaw crusher, a cone crusher or a rotary impact crusher having an assigned screening unit.

Furthermore, the invention can also be applied to combined rock crushing plants having screening stations. The explanations below are therefore only described based on a screening station by way of example. The explanations below therefore apply in particular also to the rock processing plant mentioned above.

As FIG. 1 shows, the rock processing plant 10 has a machine frame 13, which is supported by undercarriages 14, which are designed as crawler tracks, for instance. Furthermore, the rock processing plant 10 has a feed hopper 11. It can be used to feed rock material to be processed into the former. A conveyor is provided in the area of the feed hopper 11, which is formed, for instance, by a hopper discharge belt 12. Furthermore, instead of a hopper discharge belt 12, it is also conceivable to use a conveyor trough having a conveyor designed as a vibratory conveyor.

Adjacent to the feed hopper 11, the rock processing plant 10 has a screening unit 20.

As FIG. 1 shows, the screening unit 20 has an upper screen deck 21 downstream of the hopper discharge conveyor 12. The rock material is conveyed onto this screen deck 21 by means of the hopper discharge conveyor 12. The screen deck 21 has a screen grate having a predetermined mesh size. Rock material, which cannot fall through the screen deck 21 due to the grain size, is conveyed onto a conveyor belt 15 designed as an endlessly circulating conveyor belt and from there onto a dump pile. The rock material that falls through the screen deck 21 reaches the screen deck 22 below. The screen deck 22 in turn has a predetermined mesh size. Rock material that does not fall through the screen deck 22 is fed to a lateral discharge belt 17. This lateral discharge belt 17 extends laterally out of the working area of the screening unit 20. The screened-out material is piled up, as shown in FIG. 1. The screen material, which falls through the screen deck 22, reaches a conveyor 23, for instance an endlessly circulating conveyor belt. This screened-out fine material is routed to a fine grain discharge belt 16 and thus discharged from the working area of the machine. The screened-out fine material is piled up again on the side of the machine. The two screen decks 21 and 22 are driven by means of vibration drives, in particular eccentric drives.

The conveyor 15 can be moved to a lower position such that the overflow upper deck material of the screen deck 21 and the overflow lower deck material of the screen deck 22 are discharged via the conveyor belt 15 and thus only two screen fractions are screened out. Accordingly, only one lateral fine grain conveyor belt 16 has been installed. Accordingly, the lateral discharge belt 17 can be omitted or it has either been dismantled or moved to a position/arrangement at the plant, in which this lateral discharge belt is accordingly out of function.

Furthermore, it is conceivable that the fine grain discharge belt 16 and the lateral discharge belt 17 can be mounted on the machine frame 13 to either side of the machine. Furthermore, it is conceivable that the fine grain discharge belt 16 and the lateral discharge belt 17 are located on the same side of the plant.

Figure 2:
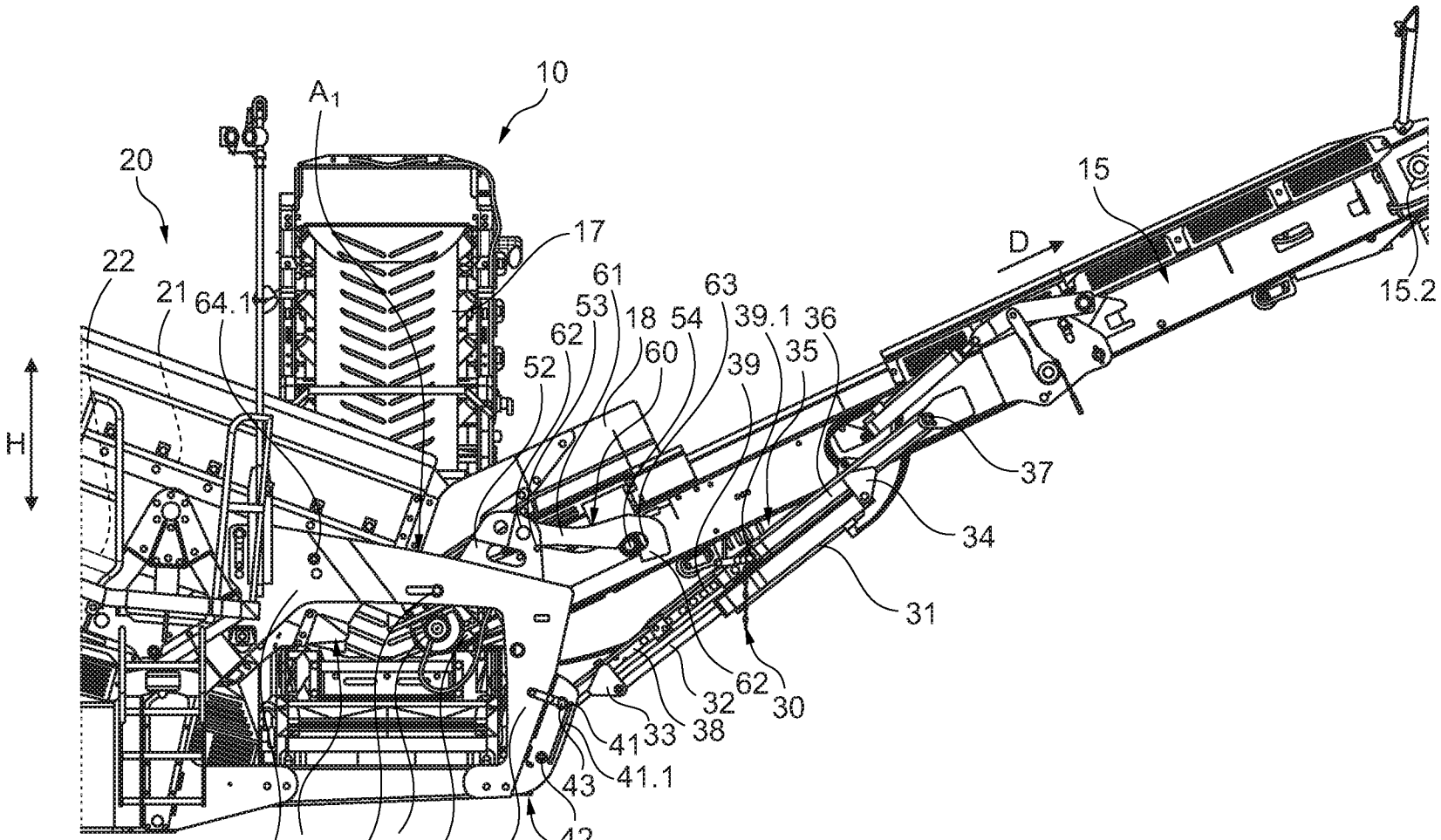
FIG. 2 shows an enlarged detail of the rock processing plant in a first operating position.

FIG. 2 shows an enlarged detail of the rock processing plant 10 more clearly. As this illustration shows, the transport device 15 has a frame, which supports the endless circulating conveyor belt 15.3. The transport device 15 forms a feed area 15.1 and a discharge area 15.2. The feed area 15.1 may be referred to as a transport conveyor belt feed area 15.1. The discharge area 15.2 may be referred to as a transport conveyor belt discharge area 15.2.

The transport device 15 is secured to the machine frame 13. For this purpose, the machine frame 13 has a beam 50. A first swivel bearing 15.4 is arranged on the beam 50, on which the transport device 15 is swivel mounted.

The transport device 15 is supported by means of a support 30 relative to the machine frame 13, for instance at an arm 51 of the beam 50, as shown in FIG. 2. The support 30 has two support parts 36 and 38, which can be moved linearly relative to each other, for instance telescoped relative to each other. The support part 36 is equipped with form-fit elements 39. These can be designed as drilled holes, as the drawing shows by way of example. There are form-fit counter elements 39.1, which can also be designed as drilled holes on the support part 36. In the control position of the transport device 15 shown in FIG. 2, a bolt can be inserted through the aligned drilled holes (form-fit element 39 and form-fit counter element 39.1). In this way, a locking device 35 is formed. The various positions defined by the placement of the bolt in the drilled holes 39, 39.1 of the support parts 36 and 38 may be referred to as locking positions.

The support 30 is swivel coupled to the transport device 15 via a swivel bearing 37. On the opposite side, the support 30 is supported on a support part 40 of the machine frame 13 by means of a mounting element 43. The support part 40 can be attached to an arm 51 of the beam 50, as shown in FIG. 2 by way of example. The attachment to the support part 40 is designed in such a way that a detachable connection is provided here. This can be achieved, for instance, by means of a bolt, which is inserted through aligned holes in the support part 40 and in the support part 38. Because the locking device 35 locks the two support parts 36 and 38 relative to each other in a form-fitting manner, they cannot be moved relative to each other. This results in a fixed support length. The support 30 can therefore be used to support the transport device 15 on the machine frame 13

As FIG. 2 further shows, a mechanical actuator 31 can be assigned to the support 30. In this exemplary embodiment, the mechanical actuator 31 is designed as a hydraulic cylinder. It is also conceivable to use other mechanical actuators 31, for instance a gear arrangement, a servomotor or the like. The hydraulic cylinder has a piston rod, which forms an actuating element 32. A connector 33 is used to connect the actuating element 32 to the support part 38. At the opposite end, a connector 34 is used to firmly couple the hydraulic cylinder to the second support part 36.

FIG. 2 clearly shows that the screening unit 20 has the screen decks 21 and 22 described above. The two screen decks 21, 22 are arranged offset from each other in the vertical direction H, i.e. in the direction of gravity. Each of the screen decks 21, 22 has a discharge area A1 and A2, respectively. A1 forms the discharge area of the first screen deck 21 and A2 forms the discharge area of the second screen deck 22. The discharge area A1 may be referred to as a first screen deck discharge area A1. The discharge area A2 may be referred to as a second screen deck discharge area A2.

FIG. 2 clearly shows that the discharge area A1 of the first screen deck 21 is assigned to, i.e. coincides with, the feed area 15.1 of the transport device 15. The discharge area A2 of the second screen deck 22 is routed to the feed area of the lateral discharge belt 17.

The conveyor belt 15 has a hopper 18 to permit an orderly transfer of the rock material. This prevents rock material from falling off the side of the feed area 15.1. The lateral discharge conveyor 17 can also be equipped with such a hopper.

During the operation of the plant, the rock material is fed from screen deck 21 in the discharge area A1 to the feed area 15.1 of the transport device 15. The rock material is then moved in the transport direction D along the transport device 15 and routed to the dump pile (see FIG. 1). In the same way, the rock material of the underlying screen deck 22 is fed to the lateral discharge conveyor 17. It is routed along a conveying direction via the lateral discharge conveyor 17 to a dump pile.

As described above, the rock processing plant 10 can now be converted such that both rock fractions from the screen decks 21 and 22 are fed onto the transport device 15. As described above, for this purpose the lateral discharge conveyor 17 is removed or adjusted such that it is moved out of the discharge area A2.

As FIG. 2 illustrates, a holder 61 is attached to the machine frame 13 in a swiveling manner by means of a joint 62. The holder 61 can, for instance, be attached to a lug 52 of the beam 50 in a swiveling manner. The holder 61 has a lever at the end of which there is a catch element 63. The catch element 63 is designed in the form of an undercut recess. The holder 61 and its catch element 63 are particularly preferably designed to have the form of a swivel hook.

In the home position shown in FIG. 2, a ramp 63.1 of the catch element 63 is in contact with a retaining element 54. The retaining element 54 may be designed to be a pin or bolt. The retaining element 54 is secured to the transport device 15.

Figure 3:
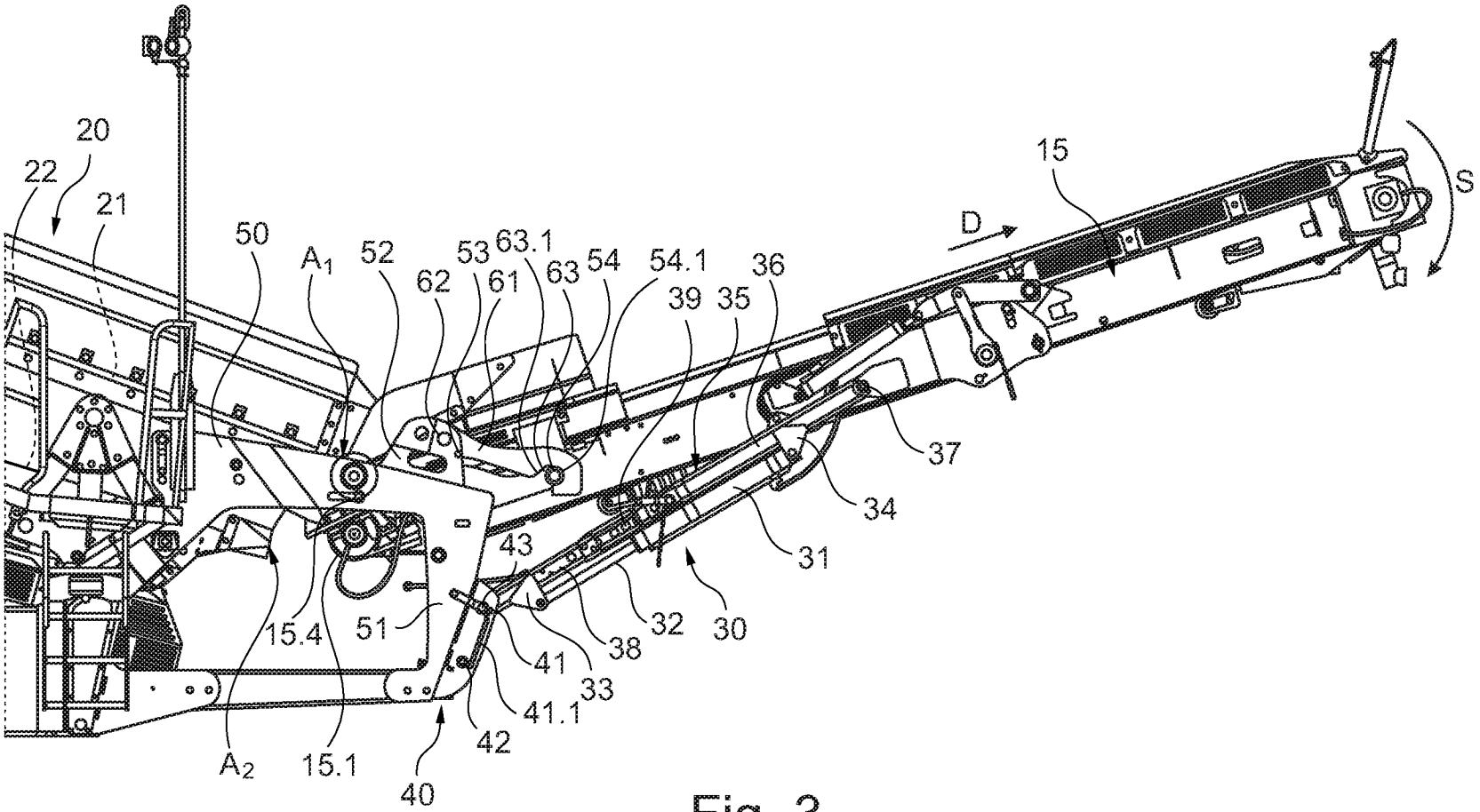
FIG. 3 shows a further enlarged detail of the rock processing plant.

FIG. 2 shows that in the basic position the holder 61 is supported on the lug 52 by a securing element 53. The securing element 53 prevents the holder 61 from turning downwards. To convert the transport device 15, first the securing element 53 is removed. Then the locking device 35 is released and the form-fit connection formed there is opened. Now the mechanical actuator 31 can be activated, wherein the distance between the two connectors 33, 34 is reduced. This can be done by retracting the actuating element 32 (piston rod) into the hydraulic cylinder. During this motion the inclination of the transport device 15 is adjusted. In FIG. 3 this inclination adjustment is symbolized by the arrow S, which shows the swivel motion. As soon as the retaining element 54 is caught in the catch element 63 in a form-fitting manner, the transport device 15 cannot be moved any further in the direction of the swivel motion S. The transport device 15 is now secured at the first swivel bearing 15.4 and at the holder 61.

Because in this position no forces act on the support 30 and thus on the actuator 31, the mounting element 43 can be released.

FIG. 3 shows that the support 30 has a guide piece 41, which is located in the area of the support part 40. This guide piece 41 can be linearly adjusted in a guide 41.1 of the support part 40. When the mounting element 43 is released, the hydraulic cylinder can be activated. In doing so, the actuating element 32 is extended. As a result of this extension motion, the guide piece 41 in the guide 41.1 moves to the position shown in FIG. 4. In this position, a mounting element 42 can again be used to connect the support 30 to the beam 50 in a form-fitting manner. This can be done again, for instance, using a pin or a bolt. In this position the transport device 15 is now supported in a statically overdetermined manner on the holder 61, the support 30 and the first swivel bearing 15.4. Therefore, the connection of the first swivel bearing 15.4 can be opened. The first swivel bearing 15.4 may, for instance, be formed in such a way that the beam 50 and the transport device 15 have aligned holes through which a pin or bolt is inserted. This pin or bolt can now be pulled to open the first swivel bearing 15.4. The transport device 15 is then secured on the machine frame 13 in a statically determined manner by the holder 61 and the support 30.

Figure 4:
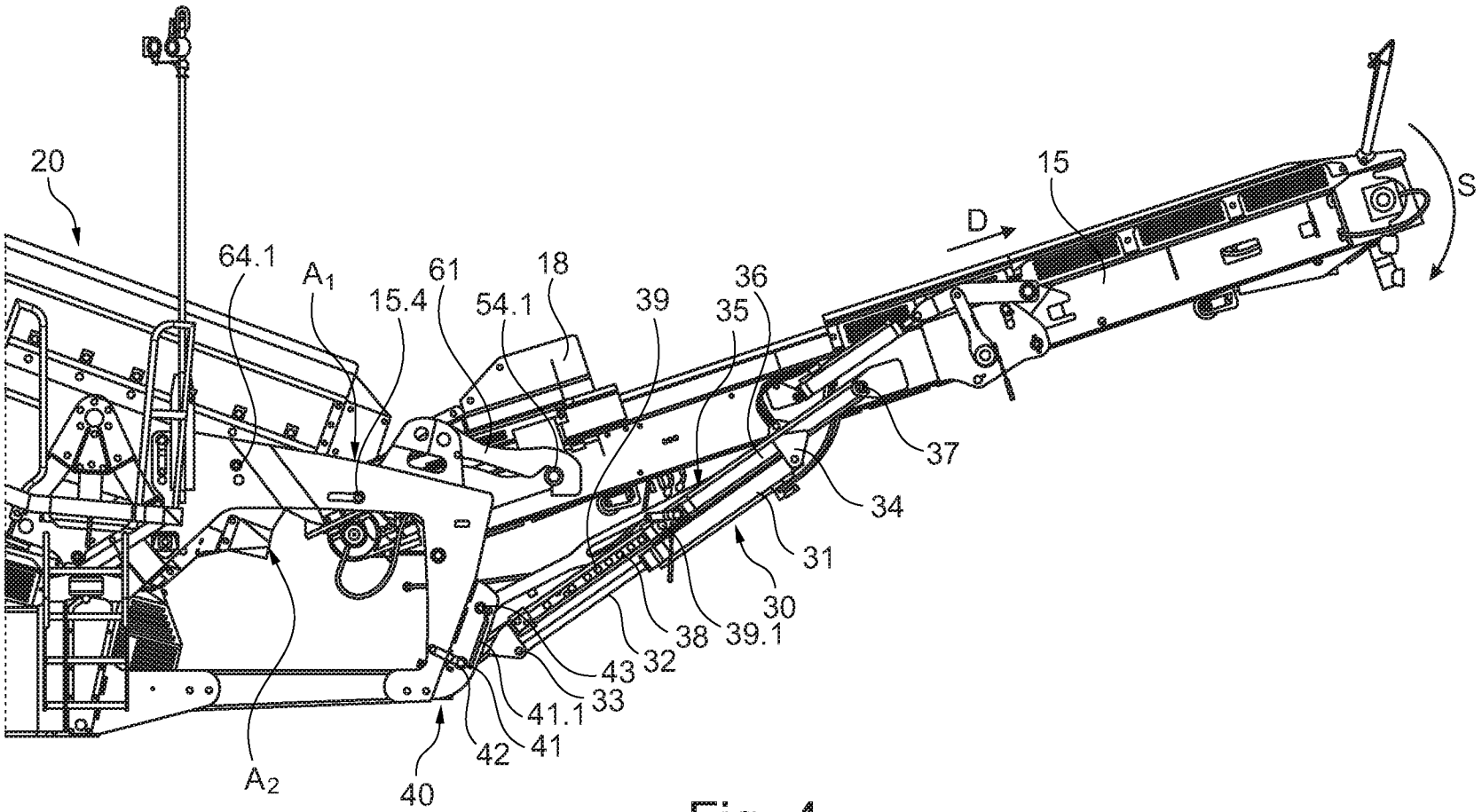
FIG. 4 shows the rock processing plant of FIG. 3 in transition toward a second operating position.
Figure 5:
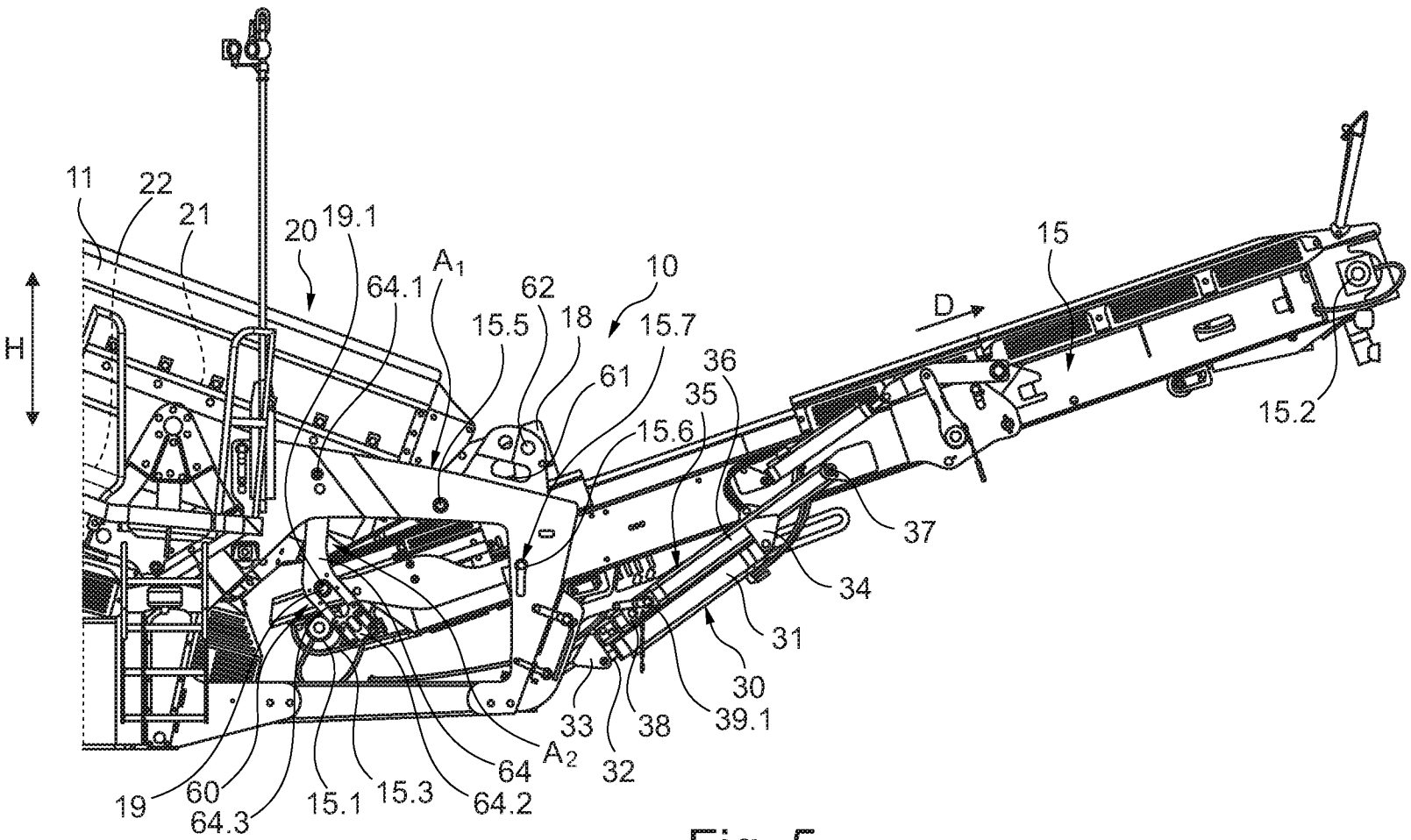
FIG. 5 shows the rock processing plant of FIG. 4 in the second operating position.

FIGS. 4 and 5 show the transition of the transport device 15, wherein the feed area 15.1 of the transport device 15 is moved from the first control position according to FIG. 4 to the second control position according to FIG. 5. During this positioning motion, the feed area 15.1 is adjusted both in the vertical direction H and in the transport direction D of the transport device 15.

The positioning motion is guided using a swivel mechanism 60. The swivel mechanism 60 comprises the holder 61 described above and the swingarm 64, which is clearly visible in FIG. 5. The holder 61 and the swingarm 64 are each connected to the machine frame 13, preferably the beam 50, via one joint 62, 64.1 each in a swiveling manner. The swivel axis is perpendicular to the image plane as shown in FIG. 5. Furthermore, the holder 61 and the swingarm 64 are connected to the transport device 15 via a further joint 54.1 and 19.1 each. The joints 62, 64.1, the further joints 54.1 and 19.1 and the holder 61 and the swingarm 64 are used to form a four-bar linkage system, in this exemplary embodiment a parallelogram four-bar linkage system.

The four-bar linkage system does not necessarily have to be a parallelogram. If it is a parallelogram four-bar linkage system, the angle of attack of the discharge belt remains the same before and after the belt is shifted. If the four-bar linkage system deviates from the parallelogram shape, the angle of attack of the belt will also change with the shifting of the belt.

Actually, in the example shown here, the parallelogram is not a proper parallelogram but the deviation from the parallelogram shape is marginal. This means that the angle of attack of the take-off belt before and after shifting remains almost the same but not exactly the same.

If now, starting from the first control position according to FIG. 4, the actuator 31 is actuated, the distance between the two connectors 33, 34 decreases. As a result of this shortening, both the holder 61 and the swingarm 64 swing downwards. This causes the transport device 15 to be moved to the second control position, as shown in FIG. 5. Due to the use of a parallelogram four-bar linkage system, the inclination of the transport device 15 is preferably kept constant during this adjustment. It is of course also conceivable that a four-bar linkage system that is not a parallelogram four-bar linkage system could be used, in which the connecting line between the axes of articulation of the joint 62 and the further joint 54.1 on the one hand and the connecting line between the axes of articulation of the first swivel bearing 15.4 and the further joint 19.1 on the other hand, are not parallel. In this case, however, the inclination of the transport device 15 in relation to the horizontal changes when moving from the first control position to the second control position.

In the second control position shown in FIG. 5, the feed area 15.1 of the transport device 15 is arranged such that it is assigned to both the discharge area A1 of the first screen deck 21 and the discharge area A2 of the second screen deck 22. Both screen decks 21 and 22 can therefore feed the rock material guided thereon onto the transport device 15. The hopper 18 is designed to prevent rock material from falling off both screen decks 21 and 22.

As FIG. 5 shows, the holder 61 is adjusted such that the retaining element 54 of the other joint 54.1 is aligned with a bearing support 15.7. A second swivel bearing 15.6 can be formed by means of this bearing support 15.7 and the retaining element 54. This is possible, for instance, if retaining element 54 has a bearing bore, which is aligned with the bearing support 15.7. A pin or bolt can then be inserted through the aligned holes to form the bearing axis. The second swivel bearing 15.6 now forms the axis about which the transport device 15 can be swiveled to adjust its angle of inclination.

This inclination adjustment is again performed by means of the actuator 31. If the actuator 31 is used to increase the distance between the connectors 33, 34, the angle of inclination of the transport device 15 in relation to the horizontal increases as well. The swivel motion S is made possible in particular because one articulation link 19 of the further joint 19.1 of the swingarm 64 can be moved in a positioning guide 64.3, for instance a slotted hole. The minimum and maximum setting angle of the transport device 15 is limited by the ends 64.2 of the slotted hole, against which the articulation link 19 strikes in both extreme positions. The control position is again fixed by means of the locking device 35, as described above.

If the transport device 15 is now to be moved conversely from the second control position shown in FIG. 5 to the first control position shown in FIG. 2, the working sequence described above must be performed in the reverse direction.

LIST OF THE REFERENCE NUMERALS

Following is a summary of the reference numerals:

10 Rock processing plant
11 Feed hopper
12 Hopper discharge belt
13 Machine frame
14 Chassis
15 Transport device
15.1 Feed area
15.2 Discharge area
15.3 Conveyor belt
15.4 First swivel bearing
15.5 Bearing bore
15.6 Second swivel bearing
15.7 Bearing support
16 Fine grain conveyor belt
17 Lateral discharge conveyor
18 Hopper
19 Articulation link
19.1 Further joint
20 Screening unit
21 Screen deck
22 Screen deck
23 Conveyor
30 Support
31 Mechanical actuator
32 Actuating element
33 Connector(s)
34 Connector(s)
35 Locking device
36 Support part
37 Swivel bearing
38 Support part
39 Form-fit element
39.1 Form-fit counter element
40 Support part
41 Guide piece
41.1 Guide
42 Mounting element
43 Mounting element
50 Beam
51 Arm
52 Lug
53 Securing element
54 Holding element
54.1 Further joint
60 Swivel mechanism
61 Holder
62 Joint
63 Catch element
63.1 Ramp
64 Swingarm
64.1 Joint
64.2 End
64.3 Positioning guide
S Swivel motion
D Transport direction
A1 Discharge area screen deck 1
A2 Discharge area screen deck 2
H Vertical direction

The invention claimed is:

1. A rock processing plant, comprising:

a machine frame;

a screening unit supported on the machine frame, the screening unit including at least first and second screen decks offset from each other in a vertical direction, the first and second screen decks having first and second screen deck discharge areas, respectively;

a transport device including an endless circulating transport conveyor belt extending in a transport direction at least partially between a transport conveyor belt feed area and a transport conveyor belt discharge area; and a mechanical actuator connected between the machine frame and the transport device, the mechanical actuator being configured to move the transport conveyor belt feed area of the transport device between a first control position wherein only the first screen deck discharge area coincides with the transport conveyor belt feed area, and a second control position wherein both of the first and second screen deck discharge areas coincide with the transport conveyor belt feed area, wherein the mechanical actuator is configured to move the transport conveyor belt feed area between the first and second control positions in both the vertical direction and the transport direction;

wherein in the first control position the transport device is attached to the machine frame by a first swivel bearing configured such that the transport device can be swiveled about a first swivel axis to change an inclination of the transport device; and wherein in the second control position the transport device is attached to the machine frame by a second swivel bearing configured such that the transport device can be swiveled about a second swivel axis to change the inclination of the transport device.

2. The rock processing plant of claim 1, wherein:

in each of the first and second control positions the inclination of the transport device can be adjusted in an angular range between about 0° and at least about 35°.

3. The rock processing plant of claim 1, wherein:

the mechanical actuator is configured to effect both the change in inclination of the transport device and the movement of the transport device between the first and second control positions.

4. A rock processing plant, comprising:

a machine frame;

a screening unit supported on the machine frame, the screening unit including at least first and second screen decks offset from each other in a vertical direction, the first and second screen decks having first and second screen deck discharge areas, respectively;

a transport device including an endless circulating transport conveyor belt extending in a transport direction at least partially between a transport conveyor belt feed area and a transport conveyor belt discharge area;

a mechanical actuator connected between the machine frame and the transport device, the mechanical actuator being configured to move the transport conveyor belt feed area of the transport device between a first control position wherein only the first screen deck discharge area coincides with the transport conveyor belt feed area, and a second control position wherein both of the first and second screen deck discharge areas coincide with the transport conveyor belt feed area, wherein the mechanical actuator is configured to move the transport conveyor belt feed area between the first and second control positions in both the vertical direction and the transport direction; and a locking device including a first support part connected to the machine frame and a second support part connected to the transport device, the first and second support parts being adjustable in position relative to each other, and the first and second support parts being lockable relative to each other using a form-fit element in a plurality of locking positions corresponding to different inclinations of the transport device.

5. The rock processing plant of claim 4, wherein:

the mechanical actuator is coupled to the first and second support parts such that the first and second support parts are moved relative to each other when the mechanical actuator moves.

6. The rock processing plant of claim 4, wherein:

the mechanical actuator or the first support part is configured to rest on a further support part of the machine frame or of the transport device in a form-fitting manner in either of at least two mounting positions spaced apart in the vertical direction.

7. The rock processing plant of claim 6, wherein:

the further support part includes a guide; and the mechanical actuator or the first support part includes a guide piece received in the guide to at least partially guide movement of the mechanical actuator or the first support part between the two mounting positions.

8. A rock processing plant, comprising:

a machine frame;

a screening unit supported on the machine frame, the screening unit including at least first and second screen decks offset from each other in a vertical direction, the first and second screen decks having first and second screen deck discharge areas, respectively;

a transport device including an endless circulating transport conveyor belt extending in a transport direction at least partially between a transport conveyor belt feed area and a transport conveyor belt discharge area;

a mechanical actuator connected between the machine frame and the transport device, the mechanical actuator being configured to move the transport conveyor belt feed area of the transport device between a first control position wherein only the first screen deck discharge area coincides with the transport conveyor belt feed area, and a second control position wherein both of the first and second screen deck discharge areas coincide with the transport conveyor belt feed area, wherein the mechanical actuator is configured to move the transport conveyor belt feed area between the first and second control positions in both the vertical direction and the transport direction; and a swivel mechanism connecting the transport device to the machine frame, the swivel mechanism being configured to guide the transport conveyor belt feed area between the first and second control positions.

9. The rock processing plant of claim 8, wherein:

the swivel mechanism includes a holder and a swingarm, the holder and the swingarm each being coupled directly or indirectly to the machine frame by one joint and to the transport device by a further joint to form a four-bar linkage system.

10. The rock processing plant of claim 9, further comprising:

a holding element arranged on the transport device or on the machine frame;

wherein the holder of the swivel mechanism includes a catch element; and wherein in one position of the transport device the catch element is not in engagement with the holding element and in another position of the transport device the catch element is in engagement with the holding element.

11. The rock processing plant of claim 10, wherein:

in the first control position the transport device is attached to the machine frame by a first swivel bearing configured such that the transport device can be swiveled about a first swivel axis to change an inclination of the transport device; and in the second control position the transport device is attached to the machine frame by a second swivel bearing configured such that the transport device can be swiveled about a second swivel axis to change an inclination of the transport device, the second swivel bearing being formed by the holding element and catch element.

12. The rock processing plant of claim 11, wherein:

in the second control position the transport device is configured to be swiveled relative to the swingarm about an articulation axis defined by an articulation link, and the swingarm includes a positioning guide, the articulation link being movable within the positioning guide transverse to the axis of articulation.

* * * * *